US008998517B2

(12) United States Patent
Giancana et al.

(10) Patent No.: US 8,998,517 B2
(45) Date of Patent: Apr. 7, 2015

(54) HEAT-GENERATING APPLICATOR HEAD

(75) Inventors: Peter Giancana, Smithtown, NY (US); Stephen van Beek Faletti, Brooklyn, NY (US)

(73) Assignee: ELC Management, LLC, New York, NY (US)

( * ) Notice: Subject to any disclaimer, the term of this patent is extended or adjusted under 35 U.S.C. 154(b) by 388 days.

(21) Appl. No.: 13/643,621

(22) PCT Filed: Apr. 18, 2011

(86) PCT No.: PCT/US2011/032916

§ 371 (c)(1), (2), (4) Date: Mar. 28, 2013

(87) PCT Pub. No.: WO2011/139537

PCT Pub. Date: Nov. 10, 2011

(65) Prior Publication Data

US 2013/0206161 A1 Aug. 15, 2013

Related U.S. Application Data

(60) Provisional application No. 61/331,955, filed on May 6, 2010.

(51) Int. Cl.
*A46B 11/08* (2006.01)
*A45D 40/26* (2006.01)

(52) U.S. Cl.
CPC ..... *A45D 40/262* (2013.01); *A45D 40/265* (2013.01); *A45D 2200/157* (2013.01); *A46B 11/08* (2013.01); *A46B 2200/1053* (2013.01)

(58) Field of Classification Search
CPC ..... A45D 2200/157; A45D 40/265; A45D 40/262; A46B 11/08; A46B 2200/1053
USPC ..... 401/1, 126; 132/218
See application file for complete search history.

(56) References Cited

U.S. PATENT DOCUMENTS

| | | | |
|---|---|---|---|
| 3,892,248 | A | 7/1975 | Kingsford |
| 4,545,393 | A | 10/1985 | Gueret et al. |
| 5,094,254 | A | 3/1992 | Krueckel et al. |
| 5,775,344 | A | 7/1998 | Clay |
| 5,816,728 | A | 10/1998 | Nardolillo et al. |
| 5,853,010 | A | 12/1998 | Suh |

(Continued)

FOREIGN PATENT DOCUMENTS

| | | | |
|---|---|---|---|
| JP | 10-192037 | A | 7/1998 |
| JP | 2006-034772 | | 2/2006 |

(Continued)

OTHER PUBLICATIONS

PCT International Search Report; International Application No. PCT/US2011/032916; Completion Date: Dec. 28, 2011; Date of Mailing: Jan. 2, 2012.

(Continued)

*Primary Examiner* — Jennifer C Chiang
(74) *Attorney, Agent, or Firm* — Peter Giancana

(57) ABSTRACT

A heated cosmetic applicator that has a plurality of small, individual heating elements placed within and/or on at least some of the lash grooming elements. A heat-generating applicator head for a heated cosmetic applicator that has a plurality of small, individual heating elements placed within and/or on at least some of the lash grooming elements.

20 Claims, 4 Drawing Sheets

(56) References Cited

U.S. PATENT DOCUMENTS

| | | | | |
|---|---|---|---|---|
| 6,345,626 | B1 | 2/2002 | Bouix | |
| 6,691,716 | B2 | 2/2004 | Neuner et al. | |
| 7,465,114 | B2 | 12/2008 | Kress et al. | |
| 7,753,609 | B2 | 7/2010 | Bouix et al. | |
| 8,262,302 | B1 * | 9/2012 | Bouix et al. | 401/1 |
| 8,308,383 | B2 | 11/2012 | Bouix et al. | |
| 2002/0168214 | A1 | 11/2002 | Carullo et al. | |
| 2005/0031400 | A1 | 2/2005 | Marcotte et al. | |
| 2007/0286665 | A1 | 12/2007 | Bouix et al. | |
| 2008/0216857 | A1 | 9/2008 | Tranchant et al. | |

FOREIGN PATENT DOCUMENTS

| | | | |
|---|---|---|---|
| JP | 2009-539494 | A | 11/2009 |
| KR | 20-2009-0012373 | | 12/2009 |
| WO | WO-2007/114551 | | 10/2007 |

OTHER PUBLICATIONS

PCT Written Opinion of the International Searching Authority; International Application No. PCT/US2011/032916; Completion Date: Dec. 28, 2011; Mailing Date: Jan. 2, 2012.

* cited by examiner

HEAT-GENERATING APPLICATOR HEAD

CROSS-REFERENCE TO RELATED APPLICATIONS

This application claims priority from U.S. Provisional Patent Application No. 61/331,955, filed May 6, 2010.

FIELD OF THE INVENTION

The present invention pertains heated cosmetic applicators, in particular, applicators having heating elements in located in the applicator head.

BACKGROUND OF THE INVENTION

The most common mascara applicator is the mascara brush. A classic mascara brush has a bristle head that comprises a collection of individual filaments disposed within a helical wire core. The wire core depends from one end of an elongated stem, while the other end attaches to a handle. Also known, are molded bristle heads, which are fashioned as a cylindrical sleeve with integrally molded bristle elements radiating from the sleeve. The molded sleeve may be slipped over one end of an elongated stem, while the other end of the stem attaches to a handle. In either case, the radially extending bristles, collectively, form a bristle head or applicator head, the "working portion" of the applicator. For a review of those brush parameters that are recognized by a person of ordinary skill in the art to be results-effective, see U.S. Pat. No. 7,465,114, herein incorporated by reference, in its entirety.

Mascara applicators that utilize individual "lash grooming elements" other than bristles, are known. U.S. Pat. No. 3,892,248 describes an applicator comprising a central shaft (or core) along the length of which rigid triangular plates outwardly project, many such plates being parallel to each other. The regularly spaced plates are reportedly suitable for loading, transferring, coating and separating. U.S. Pat. No. 4,545,393 described a bellows capable of being lengthened or shortened by the user as required. The stacked "teeth" of the bellows provide surfaces for holding mascara and the spacing between the teeth allows the eyelashes to be coated and separated. U.S. Pat. No. 5,094,254 describes a central core with a ribbed profile. The individual ribs provide surfaces for holding mascara and the spacing between the ribs allows the eyelashes to be coated and separated. U.S. Pat. No. 5,816,728, herein incorporated by reference, in its entirety, describes a beaded mascara applicator, that is a mascara applicator having one or more beads disposed on a central axle extending longitudinally from an elongated rod and handle. A first preferred embodiment comprises a single cylindrical bead molded from plastic and having a series of longitudinally spaced grooves along the length of the bead. A second preferred embodiment comprises a plurality of about 5 to 7 beads disposed on a metal axle and retained by means of a flat-headed pin. The beads are capable of individually or collectively rotating about the axle to create optimal mascara application and lash separation. Preferably the diameter of the spherical beads ranges from 0.80 to 7.0 millimeters and the length of the non-spherical beads may range from 0.80 to 9.0 millimeters. U.S. Pat. No. 6,345,626 and U.S. Pat. No. 6,691,716 disclose a mascara applicator having an array of independent discs which compress during withdrawal from a container so that excess product can be removed from the applicator by a wiper. After passage through the wiper, the discs return to their expanded position by the action of a spring. The compressing of the discs during withdrawal allows a controlled amount of product to remain on the applicator for application by the consumer, and the returning of the discs to their expanded position by the spring causes the discs to assume a configuration which allows the applicator to effectively comb and separate the eyelashes.

Heating cosmetic applicators are known, in particular, heated applicators for mascara. For example, U.S. Pat. No. 5,775,344 discloses a mascara applicator having a heat facilitating strip located within the wall of the applicator rod. The heat facilitating strip is continuously distributed along the rod or stem of the applicator. Various other heated cosmetic applicators are known in which the heating element is an extended component, continuously distributed along a rod or stem of the applicator. For example, copending application U.S. Ser. No. 12/732,835 (herein, incorporated by reference, in its entirety), discloses heating applicators that comprise a plurality of discrete heating elements that are arranged with regard to the linear distribution of the bristles. For example, disclosed are heated applicators that have a specified number of discrete heating elements per bristle turn, or per length of core, or per bristle, that number being constant or variable over the length of the core. The use of a plurality of discrete heating elements that are arranged with regard to the linear distribution of the bristles, improves the heating efficiency of the device. Here again, however, the heating elements are distributed, albeit discretely, along the rod or stern of the applicator. The product to be heated is located on the lash grooming elements, i.e. bristles. Heat must travel by conduction from inside the rod or stem to the bristles and into the product. In the process, heat is lost to materials that don't really need to be heated. Product heat up times and power consumption are adversely affected. For these reasons, commercial viability has remained low. There remains a need for a heated cosmetic applicator, in particular a heated mascara applicator, having improved heating capabilities.

OBJECTIVES

Various embodiments of the invention meet one, some or all of the following objectives. The term "objective" does not, by itself, make a feature essential.

One object of the invention is to provide a heat-generating applicator head for a heated cosmetic applicator that more efficiently heats a product located on the outer surface of the applicator head.

Another object is to provide an applicator head that has heating elements in and/or on the lash grooming elements.

Another object of the invention is a heated cosmetic applicator that offers improved control of the distribution of heat around the applicator head.

SUMMARY OF THE INVENTION

This summary is provided merely as an introduction, and does not, by itself, limit the appended claims. According to one aspect, the present invention is a heated cosmetic applicator that has a plurality of individual heating elements placed within and/or on at least some of the lash grooming elements.

According to another aspect, the present invention is a heat-generating applicator head for a heated cosmetic applicator, that has a plurality of individual heating elements associated with at least some of the lash grooming elements.

DETAILED DESCRIPTION

The present application is concerned with applicator heads for heated applicators or other handheld grooming tools, like hair brushes, combs, etc. A main focus of the present invention is mascara applicators. Although the principles described herein are more broadly applicable, the principles will be described in relation to mascara applicators and mascara application.

DEFINITIONS

"Applicator head" means the part of an applicator that delivers product from a reservoir of product to an application surface, such as the skin or hair. The applicator head may be configured with grooming elements that facilitate the delivery of product to, and spreading of product on, a specific application surface (i.e. the eyelashes).

For example, "lash grooming element" means the part of the applicator head that engages the eyelashes by depositing product, spreading product, and/or grooming the lashes (for example, by rearranging the lashes). Bristles are a type of common lash grooming element, but others exist. Some of these were discussed above.

"Handheld applicator" means an applicator that is intended to be held in one or more hands and raised in the air, as the applicator is performing one or more main activities. Main activities include loading product onto the applicator and delivering product to an application surface. Thus, "handheld" means more than just being able to grasp an object. For example, a "space heater" does not meet this definition of handheld.

Throughout the specification "comprise" means that an element or group of elements is not automatically limited to those elements specifically recited, and may or may not include additional elements.

Throughout the specification, "proximal end" of a heat generating applicator head means that end that attaches to the stem of the applicator. The "distal end" of a heat generating applicator head is opposite the proximal end.

Throughout the specification, "electrical contact" means that a current is able to flow between electronic elements, whether there is direct physical contact between the elements, or whether one or more other electronic elements intervene.

Throughout the specification, an applicator head wherein one or more individual heating elements are located within and/or on the lash grooming elements is referred to as a "heat-generating applicator head".

Figure 1:
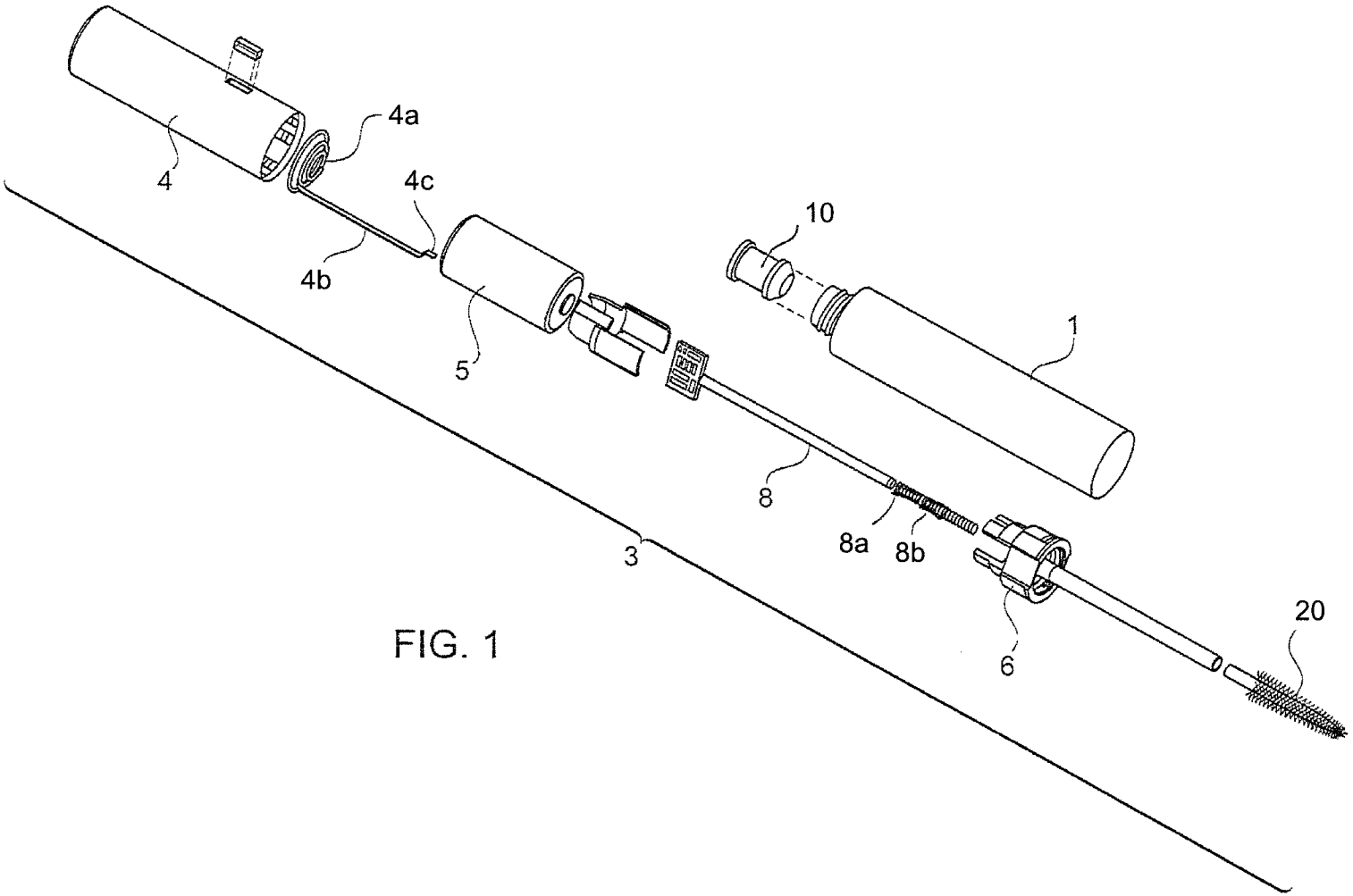
FIG. 1 is an exploded view of one embodiment of a mascara applicator having a heat-generating applicator head according to the present invention.

One embodiment of an applicator with heat-generating applicator head is shown in FIG. 1. Also shown, is a container for use with the applicator. The container (1) holds a mascara or other product. A wiper (10) may be included in the container. The heated applicator (3) includes a handle (4) for grasping by a user, which also serves as a housing for a source (5) of electric current and some associated circuitry (i.e. coil 4*a* contacts one terminal of the power source; lead 4*b* provides a path between a printed circuit board and the power source; terminal 4*c* contacts the printed circuit board). The handle may also serve as a closure for the container. Attached to the handle and extending away from the handle is a hollow stem (6). Optionally, some of the electronic circuitry is carried on a printed circuit board (PCB) (8). For example, the PCB may be an elongated structure that passes through the stem, from the electric current source toward a heat-generating applicator head (20). The heat-generating applicator head depends from the PCB or from the hollow stem. The heat-generating applicator head comprises grooming elements (21). For example, in some embodiments, the grooming elements are or include lash grooming elements. When the heat-generating applicator head is attached to the stem or PCB, then at least one set of electric leads of the heat-generating applicator head establishes electrical contact with a circuit that includes the source of electric current.

In copending application Ser. No. 12/732,835 (herein, incorporated by reference, in its entirety), a plurality of heating elements are located underneath a sleeve of a molded applicator head, but are separate from the molded applicator head. In the present invention, some or all (i.e. at least one) of the lash grooming elements (21) have an associated heating element (22). When we say that a "heating element is associated with a lash grooming element", we mean that the heating element is reposed inside the lash grooming element (FIG. 2) or on an outer surface of the lash grooming element (FIG. 3), or both. This positioning of heating elements within or on the lash grooming elements is a performance improvement over prior art cosmetic heated applicators. By positioning a heating element within or on a lash grooming element, the delivery of heat to the product located on that lash grooming element is substantially improved. The supplied heat is closer to the product being heated, so heat losses are reduced. Many prior art heated applicators use a single, continuously distributed heat source remotely located from the product on the lash grooming element. The heat source is typically buried in the stem. Thus, in this prior art, the applicator head is not heat-generating. These applicators rely on conduction of heat through parts of the applicator that don't otherwise need to be heated. This limits the effectiveness of the heating circuit to deliver heat to the product.

Furthermore, a centrally located heat source of the prior art may not diffuse heat evenly to all portions of the product located on the applicator head. Or, perhaps, a pattern of diffusion cannot be controlled or maintained. In contrast, a heat-generating applicator head (20) according to the present invention is able to target heat to selected portions of the applicator head. Thus, the heating of a product may be more even, especially when each lash grooming element (21) has it own heating element (22), or at least when the heating elements are distributed uniformly throughout the lash grooming elements. When some lash grooming elements do not have an associated heating element, the product on those lash grooming elements will still be heated by nearby lash grooming elements that do have associated heating elements. In this case, transfer of heat may primarily occur through the product, rather than through portions of the molded applicator head. Thus, the product is heated efficiently and uniformly. Alternatively, if a pattern of uneven heating is desired, this may be achieved by associating heating elements with specific lash grooming elements, but not with others. Through trial and error it may be possible to determine how many and which lash grooming elements should be supplied with heating elements, to give the best application of heated product. A preferred ratio of heating elements to lash grooming elements is from 1:30 to 1:60 or more, more preferably the ratio is from 1:15 to 1:20 or more, even more preferably the ratio is 1:5 to 1:10 or more, and most preferably the ratio of heating elements to lash grooming elements is 1:1 to 1:2 or more.

Heat-Generating Molded Applicator Heat

Figure 2:
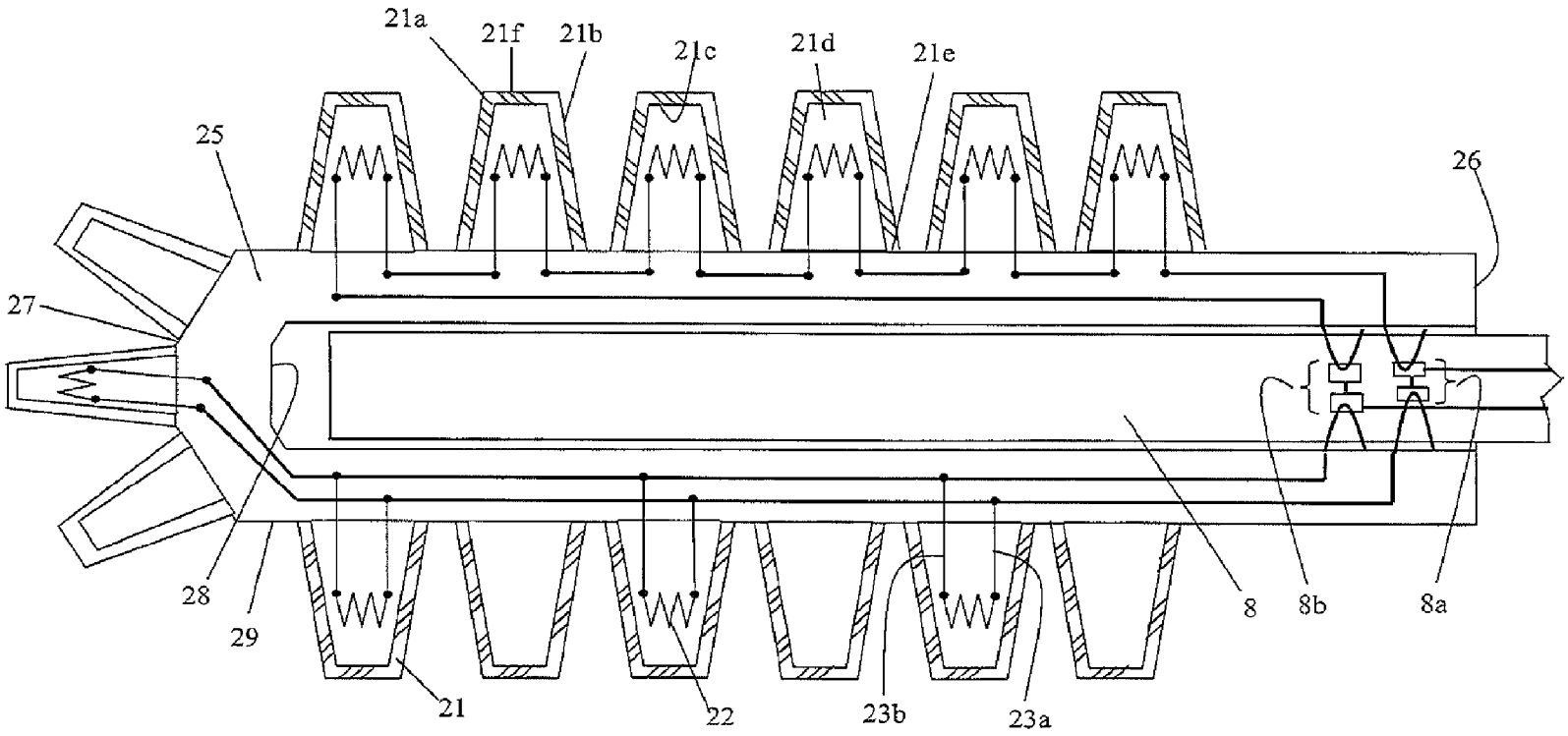
FIG. 2 depicts a heat-generating applicator head comprising hollow lash grooming elements that have heating elements located inside.
Figure 3:
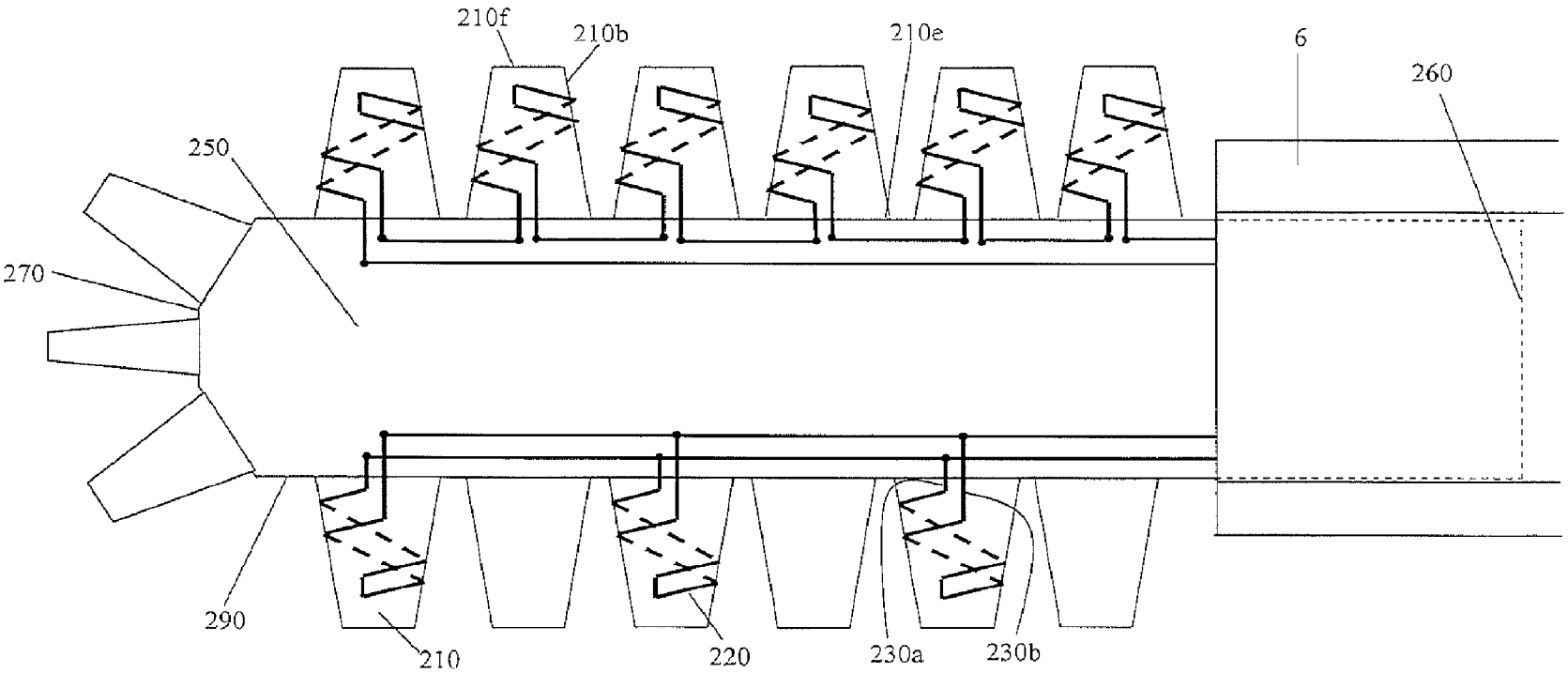
FIG. 3 depicts a heat-generating applicator head comprising solid lash grooming elements that have heating elements deposited on the outer surface.

One type of preferred heat-generating applicator head (20) is a molded applicator head. In a preferred embodiment, the molded applicator head is implemented as a molded bristle brush. A molded applicator will generally comprise a core, which may be hollow (FIG. 2) or solid (FIG. 3). In the embodiment of FIG. 2, a heat-generating molded applicator head is an elastomeric member comprising core that is fashioned as a hollow sleeve (25) having an opened, proximal end (26), an opened or closed distal end (27), an inner surface (28), and a plurality of lash grooming elements (21) projecting from an outer surface (29) of the hollow sleeve. More specifically, the lash grooming elements project from a portion of the outer surface. The lash grooming elements may be arranged over substantially all of the outer surface (except for the space between lash grooming elements), or there may be another portion of the outer surface without any lash grooming elements. The distal end of the hollow sleeve may support lash grooming elements or not. The proximal end of the hollow sleeve may attach to a distal end of the stern (6), either by receiving a portion of the stem into the hollow sleeve, or by the proximal end of the applicator head being received into the hollow stern. In another embodiment, the hollow sleeve of the molded applicator is able to receive a portion of a printed circuit board (PCB) (8) into the hollow sleeve. Preferably, the hollow sleeve attaches to the stem or PCB, as the case may be, such that the sleeve will not detach from the stem/PCB in normal handling and use. A friction fit may suffice or adhesive or other fastener may be used.

In embodiments encompassed by FIG. 2, a lash grooming element (21) has at least one wall (21*a*) having an outer surface (21*b*) and an inner surface (21*c*), a hollow portion (21*d*) defined by the inner surface(s) (21*c*), a wall thickness defined by a distance between the inner and outer surfaces, a base (21*e*) where the lash grooming element attaches to the sleeve (25) of the molded applicator head (20), and a tip (211) that projects away from sleeve. At least one and at most all of the lash grooming elements of a molded applicator head will have their own heating element (22). In some preferred embodiments, a heating element is located inside each lash grooming element that has a heating element. For example, a heating element is reposed in the hollow portion of the lash grooming element. The lash grooming element with hollow portion may be molded first, and thereafter, a heating element is placed in the hollow portion. Alternatively, a heating element may be in-molded with the lash grooming element. In the former case, there may be some empty space near the surface of the heating element. In the later case, there will be no empty space near the surface of the heating element. To the extent that empty space may reduce heating efficiency, in-molding the heating elements with the lash grooming elements is preferred. To the extent that molding the heating elements into the lash grooming elements is easier than inserting the heating elements after molding the lash grooming elements, in-molding the heating elements with the lash grooming elements is preferred.

Continuing with FIG. 2, for each heating element (22), a set of electrical leads (23*a*, 23*b*) is provided that is capable of conveying power between the heating element and an electric circuit that includes a power source (5). In general, electric leads extend from each heating element. At least some these leads are available to connect to an electric circuit that includes a power source. For example, a pair of metallic conductors may connect to a heating element, extend through the lash grooming element into which the conductors have been molded, and emerge from an inner surface (28) of the molded applicator head (20). Then, when the molded applicator head is slipped onto a stem (6) or PCB (8), electrical contact is established between the heating elements and an electric circuit that includes a power source. Alternatively, the leads of one heat generating element may establish electrical contact with the leads of one or more other heating elements, which ultimately establish electrical contact with an electric circuit that includes a power source.

In the embodiment of FIG. 3, a heat-generating molded applicator head is an elastomeric member comprising a solid core (250), a proximal end (260), a distal end (270), and a plurality of lash grooming elements (210) projecting from an outer surface (290) of the core. More specifically, the lash grooming elements project from a portion of the outer surface. The lash grooming elements may be arranged over substantially all of the outer surface (except for the space between lash grooming elements), or there may be another portion of the outer surface without any lash grooming elements. The distal end of the core may support lash grooming elements or not. The proximal end of the core may attach to a distal end of the stem (6), by being received into the hollow stem. Preferably, the core attaches to the stem such that the applicator head will not detach from the stem in normal handling and use. A friction fit may suffice or adhesive or other fastener may be used.

In embodiments encompassed by FIG. 3, a lash grooming element (210) is preferably solid, having an outer surface (210*b*), a base (210*e*) where the lash grooming element attaches to the core (250), and a tip (210*f*) that projects away from core of the molded applicator head. At least one and at most all of the lash grooming elements of a molded applicator head will have their own heating element (220). In these embodiments a heating element is located on the outside surface of those lash grooming elements that have a heating element. The lash grooming element without a heating element may be molded first, and thereafter, a heating element is positioned on the outside surface of the lash grooming element, for example, by over molding the lash grooming element.

Continuing with FIG. 3, for each heating element (220), a set of electrical leads (230*a*, 230*b*) is provided that is capable of conveying power between the heating element and an electric circuit that includes a power source (5). In general, electric leads extend from each heating element. At least some these leads are available to connect to an electric circuit that includes a power source. For example, a pair of metallic conductors may connect to and extend from a heating element, then extend along the surface of the solid core 250 toward the proximal end of the solid core. Then, when the proximal end of the solid core is slipped into the stem (6), electrical contact is established between the heating elements and an electric circuit that includes a power source. Alternatively, the leads of one heat generating element may establish electrical contact with the leads of one or more other heating elements, which ultimately establish electrical contact with an electric circuit that includes a power source.

While FIG. 3 describes an applicator head that has a solid core and solid lash grooming elements, FIG. 3 also covers embodiments in which the core and lash grooming elements are hollow or partially hollow. While FIG. 3 describes an applicator head that is received into a stem, FIG. 3 also covers embodiments in which the applicator head slides over a stem or PCB. The main point of FIG. 3, is that the heating elements are positioned on an outer surface of the lash grooming elements. Any other features described herein may find use with this main feature of FIG. 3. For example, the core of the applicator head may be hollow and slide over a PCB, as in FIG. 2, while the lash grooming elements may be solid as in FIG. 3, and the heating elements may be positioned on an outer surface of the lash grooming elements, as in FIG. 3.

Regardless of how the applicator head is rendered (i.e. molded or not; solid or hollow), various arrangements of the electric circuit are possible, and may be chosen for power efficiency, ease of manufacture, ease of assembly, or any relevant factor. For example, the heating elements and power source can be arranged in parallel (see the bottom row of heating elements in FIGS. 2 and 3) or series (see the top row of heating elements in FIGS. 2 and 3), or a combination of the two. Each heating element may connect directly to the circuit of the power supply, in which case relatively many connections need to be made when the molded applicator head is assembled to the stem or PCB. Alternatively, several heating elements may be connected to each other to form an array, such that a single set of leads is needed to connect the array of heating elements to the circuit of the power supply. A single molded applicator head may have one or more arrays. Optionally, one or more arrays could be connected to each other to form a larger array, the larger array having a single set of leads to connect the larger array of heating elements to the circuit of the power supply. Multiple arrays may be connected in series or parallel.

Various parameters of the molded applicator head, will affect the amount of heat required to raise the temperature of a product disposed on the bristles, and/or the amount of time required to do it. For example, in general the more lash grooming elements present or the larger the lash grooming elements, the more heat will be needed to raise the temperature of the product on the lash grooming elements, in a given amount of time. This is true because there is more lash grooming element mass being heated, and because there is more product than would be the case if fewer or smaller lash grooming elements were present. Different factors are important depending on the placement of the heating elements.

When the heating elements are positioned inside the lash grooming elements, then, for a specific rate of heat generation, thicker lash grooming elements mean more time will be needed to raise the temperature of the product on the lash grooming elements. This is so because there is more lash grooming element mass being heated, than if a thinner lash grooming element was used. In this case, to increase the rate of heat transfer through the lash grooming elements, and to reduce the amount of heat lost, it may be preferable to make the lash grooming elements as thin as possible, considering the limitations of molding in the specific material used, and the grooming performance of thinner, more flexible lash grooming elements. Preferably, the wall thickness of the lash grooming elements is less than 1.0 mm, more preferably less than 0.8 mm, even more preferably less than 0.6 mm and most preferably less than 0.4 mm.

Furthermore, since heat passes through lash grooming elements, the amount of heat and/or the length of time needed to raise the temperature of a product disposed on the applicator head, also depends on the thermal conductivity of the material(s). So, in general, to decrease the amount of time required to raise the temperature of the product, one might increase the rate of heat generation, decrease the mass being heated (applicator head and/or product), and/or increase the thermal conductivity of the lash grooming elements. One might consider reducing the size and mass of the lash grooming elements, but that decision should be made with regard to applicator performance in grooming the lashes.

When the heating elements are located on the outer surface of the lash grooming elements, the mass and thermal conductivity of the lash grooming elements may be less important, although, to some degree, heat is still lost to heating the lash grooming elements.

Examples of useful materials for the heat-generating molded applicator head include plastics, elastomers, or materials characterized by dipole bond crosslinking or hydrogen bond crosslinking, such as thermoplastic elastomers. A thermoplastic elastomer or a combination of more than one thermoplastic elastomer is preferred. In general, the nature of thermoplastic elastomers is such that articles can be consistently manufactured with relatively little variation from batch to batch, by extrusion molding, injection molding, blow molding, thermoforming, heat welding, calendaring, rotational molding, and meltcasting. One definition of thermoplastic elastomer includes the following necessary characteristics: the ability to be stretched to moderate elongations and, upon the removal of stress, return to something close to its original shape; be processable as a melt at elevated temperature; and the absence of significant creep. Examples of suitable thermoplastic elastomers include the following: styrenic block copolymers, polyolefin blends, elastomeric alloys (TPE-v or TPV), thermoplastic polyurethanes, thermoplastic copolyester, and thermoplastic polyamides. Examples of block copolymer TPEs include: Styroflex (BASF), Kraton (Shell chemicals), Pellethane (Dow chemical), Pebax, Arnitel (DSM), and Hytrel (Du Pont). Elastomeric alloys include: Dryflex (VTC TPE Group), Santoprene (Monsanto Company), Geolast (Monsanto), Sarlink (DSM), Forprene (So.F.Ter. S.p.a.), Alcryn (Du Pont), and Evoprene (AlphaGary). Some thermoplastic elastomers have crystalline domains where one kind of block co-crystallizes with another block in one or more adjacent chains. The relatively high melting temperature of the resulting crystal structure, tends to make the domains more stable than they otherwise would be. The specific crystal melting temperature determines the processing temperatures needed to shape the material, as well as the ultimate service use temperatures of the product. Examples of such materials include Hytrel® (a polyester-polyether copolymer) and Pebax® (a nylon or polyamide-polyether block copolymer). For the molded applicator head, Hytrel® and Pebax® are useful in particular embodiments.

Materials for the applicator head, such as thermoplastic elastomers, may be useful in a range of hardness. For example, a Shore D hardness of about 25 to about 82 is preferred for many applications. More preferred are materials having a Shore D hardness of 30 to 72. Even more preferred are materials having a Shore D hardness of 47 to 55.

Heating Elements

In one useful embodiment, the heating elements comprise an electrical resistance or impedance. Some examples of this include wire coils, carbon composition resistors, carbon film resistors, thick and thin film resistors, chip resistors, metal film and foil resistors. The type of heating element used may be chosen based on ease of positioning in or on the lash grooming element, for example, the ability to in-mold the heating elements with a molded applicator head. They may also be chosen based on the ability of the component to withstand the demands of manufacturing the molded applicator head.

In those embodiments where a heating element is located inside a lash grooming element, the size of the heating element should allow it to fit inside a lash grooming element. Heating elements may be 5.0 mm or smaller, preferably 2.0 mm or smaller, more preferably 1.0 mm or smaller, most preferably 0.5 mm or smaller. For example, one metal oxide thick film resistor available from KOA Speer Electronics, Inc (Bradford, Pa.) has a largest dimension of about 0.4 mm. A wide range of nominal resistances is available from 1Ω or less to thousands of ohms. Resistors that are smaller than 0.4 mm may be commercially feasible. For example, a resistive wire or wire coil smaller that 0.4 mm is envisioned. Preferably, the resistor or impedance components contain no lead.

In those embodiments where a heating element is located on an outside surface of lash grooming element, the heating element may be implemented as a resistive material deposited on an outer surface of the lash grooming element. Electric leads may comprises relatively conductive materials, also applied as a surface deposition, and used to connect heating elements to each other and/or to a circuit that includes a power source.

In use, a heat-generating applicator head according to the present invention is connected to a source of electric current, preferably a DC power supply. The current source may be housed within the interior of the handle, for example. The current source has at least one positive terminal and at least one negative terminal, the terminals forming part of an afferent path (going away from the current source) and efferent path (going toward the current source), respectively. Commonly, the DC power supply comprises one or more batteries. The circuit of the power source further comprises at least one on/off switch. Generally, the on/off switch is capable of alternately interrupting and re-establishing the flow of electricity between the power source and the heating elements. Examples of useful switches are described in copending application U.S. Ser. No. 12/732,835.

Typically, the circuit of the power source includes paths between the power source and the part of the stern or PCB which support the heat-generating applicator head. The part of the stem or PCB which support the heat-generating applicator head includes one or more sets of electrical leads (8*a*, 8*b*). For example, there may be one set of leads for each heating element or there may be one set of leads for each array of heating elements, or as many as are needed. In the case of a molded applicator head, when the molded applicator head is slipped onto the stem or PCB, the electric leads of the stem/PCB establish electrical contact with the electric leads of the heating elements or arrays of heating elements. For example, multiple sets of electric leads of a PCB may come into direct or indirect physical contact with multiple sets of electric leads of the heating elements. Alternatively, the electric leads of all heating elements may be connected to one set of electric terminals, and that set of terminals establishes electrical contact with the electric leads of the stem/PCB. Preferably, the sleeve of the molded applicator head and the stem or PCB are registered so that a particular arrangement of the two parts ensures that the necessary electrical contact is made. For example, the sleeve and the stem/PCB may have complementary shapes that can only be assembled one way.

As noted, in some embodiments, a heating element (22) is positioned in the hollow portion (21*d*) of a lash grooming element (21). In these cases, a heat-generating applicator head (20) may first be fashioned without the heating elements, leaving access to the hollow portions so that the heating elements may be placed therein. For example, a flexible array of heating elements may be fashioned. The array has a set of terminals that service the whole array. The flexible array may be inserted into a pre-molded applicator head through one of the open ends of a sleeve of the applicator head. As the flexible array is inserted, the flexible array bends temporarily, to fit into the sleeve. As the flexible array is inserted further, the array expands to allow heating elements to move into hollow portions of the lash grooming elements.

Alternatively, a heat-generating applicator head (20) may be fashioned with the heating elements (22), in situ. For example, a flexible array of heating elements may be fashioned. The array has a set of terminals that service the whole array. The flexible array is inserted into a mold for the applicator head, such that heating elements come to rest in portions of the mold that define the lash grooming elements. The terminals of the array are located such that the terminals are available near a surface of the molded applicator head, after molding. An elastomeric material is introduced into the mold, and subsequently the molded unit is released from the mold, with the heating elements embedded therein. The molded piece is ready for assembly to a stem of PCB.

As noted, in some embodiments, a heat generating element (220) is positioned on an outer surface (210*b*) of a lash grooming element. Because the product is directly heated (i.e. without the heat having to travel through another medium before reaching the product), the heating is very efficient. In these cases, additive manufacturing processes or layering processes may be used to make a heat-generating applicator head. For example, through computer controlled additive systems, such as those currently found in rapid prototyping/rapid manufacturing, multiple materials may be sintered together. In this embodiment, at least two materials would be used: a dielectric material which would account for the overall structure of the sleeve and lash grooming elements, and an electrically resistive material that would form the heating elements. A heat-generating applicator head would be built in small, possibly microscopic or nano-scale layers which could be carefully controlled. Each heating element could be built up as a heat-generating electrical path on a surface of a lash grooming element. The path could be designed to have a set of electrical leads for connecting the heating element to the circuit of the power source. Inherent electrical resistance in the electrical path will generate heat, and will directly heat the product on the lash grooming elements. Each heating element could be configured in various patterns and paths (linear, spiral, etc). The path length could be used to control the amount of heating. For example, the path could be designed to cover as much of the surface of the lash grooming element as possible. From 1%-99% of the outer surface of each grooming element may be covered by an electric heating path (for example, 10%-90% or 20%-80%); preferably, 25%-99% (for example 30%-70% or 40%-60%), and more preferably 50%-99% (for example 60%-90% or 70%-80%).

In an alternative embodiment, a pre-formed applicator head could be precisely sprayed with resistive ink, into a given pattern using existing 3-dimensional printing arm setups, typically found, for example, in package decoration systems. The resistive ink pattern would define a heat-generating path and have at least two terminals for continuing the electric circuit (for example, to connect to a power source). Inherent electrical resistance in the electrical path will generate heat, and will heat the lash grooming elements and product on the lash grooming elements.

In preferred embodiments, the heat-generating applicator head is implemented as a molded applicator head having a hollow sleeve and lash grooming members that project from the sleeve. In some particularly useful embodiments the lash grooming elements are bristle-like members that project from a molded sleeve. For example, a bristle may have a generally cylindrical or conical shape or frusto-conical shape. The heating elements may be deposited on an outer surface of the lash grooming elements an/or they may be located inside a hollow portion of the lash grooming elements. The hollow sleeve is designed to fit onto a stem or printed circuit board of the heated applicator, in such a way that electrical contact is established between a circuit that includes a power source and the heating elements.

In various embodiments of the present invention, a significant portion of the heating circuit is manufactured as part of the applicator head. The heating circuit is conveniently completed when the stem/PCB and applicator head are brought together. One advantage of this is the ability to mold, in advance, heat-generating applicator heads that may be used with various different applicator bodies. As long as the electrical heating circuit is completed when the parts are joined, a single type of heat-generating applicator head may be used on different mascara applicator bodies.

In other useful embodiments of a heat-generating applicator head, the lash grooming elements are other than bristles. Depending on the geometry of the lash grooming elements, the heating elements may be located within the lash grooming element or on the surface or both. For example, the lash grooming elements may be rigid triangular plates that project from a central shaft, as in U.S. Pat. No. 3,892,248. The rigid plates may have heating elements deposited on an outer surface, by a method described above, for example. Alternatively, the lash grooming elements may be a bellows, as described in U.S. Pat. No. 4,545,393. Here, the heating elements may be deposited on an outer surface of one or more components of the bellows or housed within one or more hollow portions, inside the bellows. Alternatively, the lash grooming elements may be the ribs as described in U.S. Pat. No. 5,094,254. The ribs may have heating elements deposited on an outer surface, by a method described above, for example. Alternatively, the lash grooming elements may be one or more independent discs as described in U.S. Pat. No. 6,345,626 and U.S. Pat. No. 6,691,716. The discs may have heating elements deposited on an outer surface, by a method described above, for example.

Figure 4:
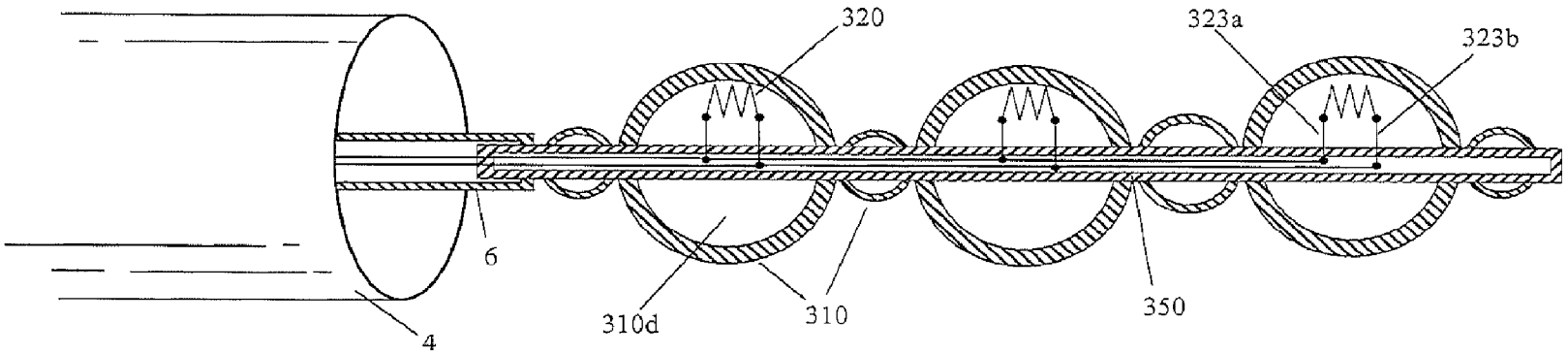
FIG. 4 is a partial cross section showing a heat generating applicator head comprising freely rotating beads that have heating elements located inside some of the beads.

Alternatively, (referring to FIG. 4) the heat-generating applicator head may comprise one or more beads (the lash grooming elements) disposed on a central axle (350) that extends longitudinally from an elongated stem (6) and handle (4), as described in U.S. Pat. No. 5,816,728. For example, there may be about 5 to 7 beads (310) disposed on the axle and retained by a flat-headed pin or other means. The beads are capable of individually or collectively rotating about the axle to create optimal mascara application and lash separation. A hollow space (310*d*) may be provided within one or more beads to house a heating element (320). Preferably the diameter of the spherical beads that house heating elements within may range from 2.0 mm to 7.0 mm and the length of the non-spherical beads that house heating elements within may range from 2.0 mm to 9.0 mm. The axle may be hollow, and electrical leads (323*a*, 323*b*) may connect the heating elements to a circuit that includes a power source. The power source may be housed in the handle. The placement of the heating elements in the beads does not prevent the beads from rotating or does not fully prevent the beads from rotating. Alternatively, the heat generating elements may be located on the outer surface of the beads. For example, the heat generating elements may be deposited as a resistive heating path, as described above. In this case, the rotation of those beads that have heating elements may be limited, but not eliminated, by the electrical connections of the heating elements to the larger circuit. Those beads without heating elements may still rotate freely.

In embodiments herein described, one or more lash grooming element is associated with its own heating element. Preferably, the heating elements become associated with the lash grooming elements by integrally molding the heating elements into the lash grooming elements, or by a surface deposition process, such as over molding or additive manufacturing.

Features that are said to enhance the performance of mascara applicators are known. It may be useful to combine these with some or all of the principles of the present invention. For example, ergonomic handles and comfort grips are known. US patent publication 2002-0168214 discloses a mascara handle grip made from one or more deformable elastomers and having a dual-tapered portion such that two tapered sections meet at a narrowest point along the dual-tapered portion, and wherein the cross section of one or both tapered sections is elliptical. Another example is U.S. Pat. No. 7,465,114, which discloses a mascara applicator with vibrating applicator head. A vibrating applicator may be able to alter the rheological properties of mascara compositions. Thus, vibration may be useful in at least some embodiments of the present invention, to achieve improved results.

Optionally, a portion of the applicator head may comprise one or more thermochromic materials. Thermochromic materials change color in predictable ways, when heated. The purpose of the thermochromic material is to provide a visual notice to a user, that the applicator has achieved a certain temperature. Preferably, the portion of the applicator that comprises a thermochromic material, is easily visible to a user during normal use of a mascara applicator. For example, preferably, at least some portion of the thermochromic material will not be covered by mascara, thereby obscuring the color change.

Optionally, the applicator head is used in conjunction with a second heating means. For example, a portion of the stem or printed circuit board that is underneath the applicator head may comprise heat-generating elements, that are separate from the heating elements in the lash grooming elements. Preferably, the heated lash grooming elements and second heating means are able to raise the temperature of a product on the applicator head to a desired temperature in an acceptable amount of time. More preferably, the heat supplied by the heated lash grooming elements is sufficient to raise the temperature of a product on the applicator head to a desired temperature in an acceptable amount of time, no second heating means being needed.

What we claim is:

1. A heat-generating applicator head comprising at least one lash grooming element that has a heating element located within or on the lash grooming element, and a set of electrical leads that is capable of conveying power between the heating element and an electric circuit that includes a power source.

2. The heat-generating applicator head of claim 1 wherein the heating element is located inside a hollow portion of the at least one lash grooming element.

3. The heat-generating applicator head of claim 1 wherein the heating element is in-molded inside the at least one lash grooming element.

4. The heat-generating applicator head of claim 1 wherein the ratio of heating elements to lash grooming elements is from 1:30 to 1:60.

5. The heat-generating applicator head of claim 4 wherein the ratio of heating elements to lash grooming elements is from 1:1 to 1:2.

6. A heat-generating molded applicator head comprising:

a hollow sleeve having an outer surface and an opened, proximal end;

lash grooming elements projecting from the outer surface of the hollow sleeve, each lash grooming element having a wall and a hollow portion; and heating elements located in the hollow portions of the lash grooming elements; and a set of electrical leads that is capable of conveying power between the array of heating elements and an electric circuit that includes a power source.

7. The heat generating applicator head of claim 6 wherein the heating elements are arranged in series or parallel.

8. The heat generating applicator head of claim 6 wherein the wall thickness of the lash grooming elements is less than 1.0 mm.

9. The heat generating applicator head of claim 6 wherein the lash grooming elements have a Shore D hardness of 25 to 82.

10. A heat-generating applicator head comprising:

one or more beads disposed on a central axle, such that the beads are capable of individually or collectively rotating about the axle;

at least one of the one or more beads having a heating element located within or on the bead; and a set of electrical leads that is capable of conveying power between the heating element and an electric circuit that includes a power source.

11. The heat-generating applicator head of claim 10 wherein the heating elements are located inside a hollow portion of those beads that have a heating element.

12. The heat-generating applicator of claim 11 wherein the at least one bead is spherical and has a diameter of about 2.0 mm to about 7.0 mm.

13. The heat-generating applicator of claim 11 wherein the at least one bead is non-spherical and has a length of about 2.0 mm to about 9.0 mm.

14. The heat-generating applicator head of claim 10/wherein the heating elements are in-molded into those beads that have a heating element.

15. The heat-generating applicator head of claim 10 wherein the heating elements are located on an outer surface of those beads that have a heating element.

16. The heat-generating applicator of claim 10 having about 5 to about 7 beads disposed on the axle.

17. A cosmetic package comprising:

a handheld, heat-generating applicator comprising:

a handle that houses the power source;

a stem attached to the handle;

an applicator head having:

at least one lash grooming element that has a heating element located within or on the lash grooming element; and a set of electrical leads that is capable of conveying power between the heating element and an electric circuit that includes the power source; and a container for use with the applicator;

a product disposed in the container; and a wiper disposed in the container.

18. The cosmetic package of claim 17 wherein the applicator head is slipped onto the stem, which establishes electrical contact between the heating element and the electric circuit that includes the power source.

19. The cosmetic package of claim 17 wherein the electric circuit comprises a printed circuit board.

20. The cosmetic package of claim 19 wherein the applicator head is slipped onto the printed circuit board, which establishes electrical contact between the heating element and the electric circuit that includes the power source.

* * * * *